US005954338A

United States Patent [19]

Hampton

[11] Patent Number: 5,954,338

[45] **Date of Patent: *Sep. 21, 1999**

[54] WATER COLUMN GAME

[76] Inventor: Terry Hampton, 404 E. Jackson, Tekonsha, Mich. 49092

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,661

[22] Filed: Feb. 5, 1997

[51] Int. Cl.[6] ..... A63F 9/14

[52] U.S. Cl. ..... 273/349; 273/445; 273/371

[58] Field of Search ..... 273/349, 371, 273/374, 375, 376, 377, 387, 389, 445

[56] References Cited

U.S. PATENT DOCUMENTS

| | | | |
|---|---|---|---|
| 2,759,731 | 8/1956 | Quinn | 273/349 |
| 3,336,030 | 8/1967 | Martell et al. | 273/349 |
| 3,342,492 | 9/1967 | Barrett | 273/349 |
| 3,362,713 | 1/1968 | Miller | 273/349 |
| 3,572,712 | 3/1971 | Vick | 273/349 |
| 4,040,622 | 8/1977 | Sinnott | 273/349 |
| 5,439,230 | 8/1995 | Mendes, Jr. | 273/349 |
| 5,566,950 | 10/1996 | Senna | 273/349 |
| 5,573,243 | 11/1996 | Bartosik | 273/349 |

*Primary Examiner*—Mark S. Graham

*Attorney, Agent, or Firm*—Reising, Ethington, Barnes, Kisselle, Learman & McCulloch, P.C.

[57] ABSTRACT

A water column game that includes a plurality of vertically oriented water columns, each having a housing disposed at the upper end thereof coaxial with and in open communication with the column. A float is freely disposed and captured within each housing. A target and valves are responsive to a game player for directing water into a lower end of each water column, such that water rises within the column and the housing in sequence so as to raise the float buoyantly within the housing. A switch is disposed at the upper end of each housing, and is responsive to contact by the float for indicating that the float has reached the upper end of the column. After each play, all water columns and housings are drained to a common sump. The water-fill volume of each column and housing is adjustable and all columns are fed from a common pump for equalizing the opportunity of each player to win.

13 Claims, 5 Drawing Sheets

WATER COLUMN GAME

The present invention is directed to games for carnivals and amusement parks, and more particularly to an improved water column game for one or more players.

BACKGROUND AND SUMMARY OF THE INVENTION

Water column games have heretofore been proposed in which one or more players attempt to fill associated vertical columns with water, the winner being the player who first fills the associated column. A problem with games of this character is to ensure that all players have an equal opportunity to win. The games must be carefully constructed to ensure that all water columns are of equal volume, and that water is supplied to all columns at identical pressure and flow rate. Game manufacturers have heretofore attempted to overcome deficiencies of design and construction by handicapping a winning player to make it more difficult for that player to win in succeeding games. However, handicapping techniques of this character are patently unfair, and are illegal in many jurisdictions.

Another problem that inheres in water column games previously proposed involves growth and accumulation of algae within the water columns. An important feature of the game is to permit observation of progress of the game among all contestants, both to enhance the experience of the game players and to attract new contestants. Algae growth within the columns is unsightly and detracts from the visual aspects of the game. Furthermore, algae growth can affect operability of the game components. Maintenance and repair of the water columns in conventional games of this character typically are time consuming and expensive, and can further exacerbate water volume inequalities among the game stations.

It is therefore a general object of the present invention to provide a water column game of the subject character that includes facility for ensuring that all players have an equal opportunity to win. In furtherance of this objective, it is a more specific object of the present invention to provide a water column game of the subject character in which each column includes facility for adjusting water-fill volume for that column so that column water volume may be equalized among all game stations, and in which water is delivered by a single pump from a single reservoir to all game columns at equal pressure and flow rate. Another object of the present invention is to provide a water column game of the subject character that is transportable between game sites, and that can accommodate vibrations during transportation without damage or otherwise affecting operability of the game mechanisms. A further object of the present invention is to provide a water column game of the subject character that is easy to repair, and that reduces or eliminates growth and accumulation of algae.

A water column game in accordance with a presently preferred embodiment of the invention comprises a vertical water column having a housing disposed at the upper end thereof coaxial with and in open communication with the column. A float is freely disposed and captured within the housing. A target and valves or other suitable means are responsive to a game player for directing water into a lower end of the water column, such that water rises within the column and the housing in sequence so as to raise the float buoyantly within the housing. A switch is disposed at the upper end of the housing, and is responsive to contact by the float for indicating that the float has reached the upper end of the column. After each play, all columns and housings are drained to a common sump. The housing preferably is of cylindrical construction, and the float preferably comprises a spherical ball freely captured within the cylindrical housing. Reduced diameter of the water column helps reduce accumulation of algae, and vertical movement of the ball within the housing tends to remove any algae that may have accumulated on the inside surface of the housing.

In the preferred embodiment of the present invention, each game station includes facility for adjusting the volume of water needed to fill the column and housing to bring the float into contact with the switch. Most preferably, this is accomplished by means of a switch contact that is adjustably positionable within each housing. In multiple-player games, the effective volume of each water column and housing can then be adjusted so that such volumes are equal at each game station. All of the game columns are fed by a single pump, so that all columns receive water at the same pressure and flow rate. In this way, each player has an equal opportunity to win during each play, and player handicapping and other undesirable and/or illegal activities of this character are avoided.

Each column and housing form an integral water column assembly that is supported in vertical orientation by the game support frame. The support also includes structure for resiliently engaging the water column assembly so as to urge the same upwardly against an opposing section of the support, while accommodating vibration during transport. A coil spring surrounds the lower end of each water column. A plate has means at opposed ends for engaging the game support, and a central opening for surrounding the lower end of the water column and engaging the coil spring so as to capture the spring in compression and thereby urge the water column assembly upwardly against an opposing section of the support. Removal of the plate permits the column assembly to be removed as a unit from the support structure for repair or replacement.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
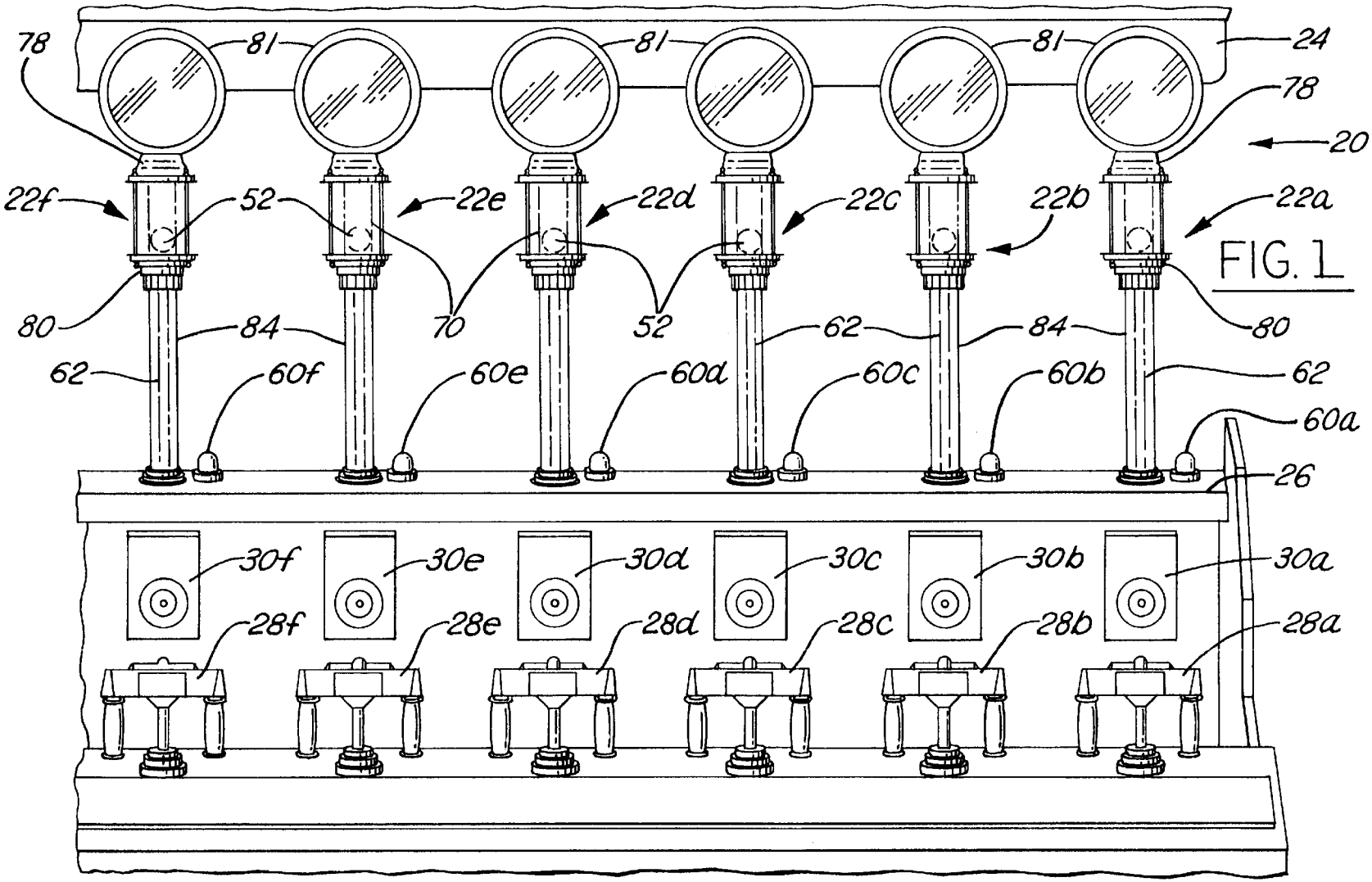
FIG. 1 is a fragmentary elevational view of a portion of a water column game in accordance with a presently preferred embodiment of the invention.
Figure 2:
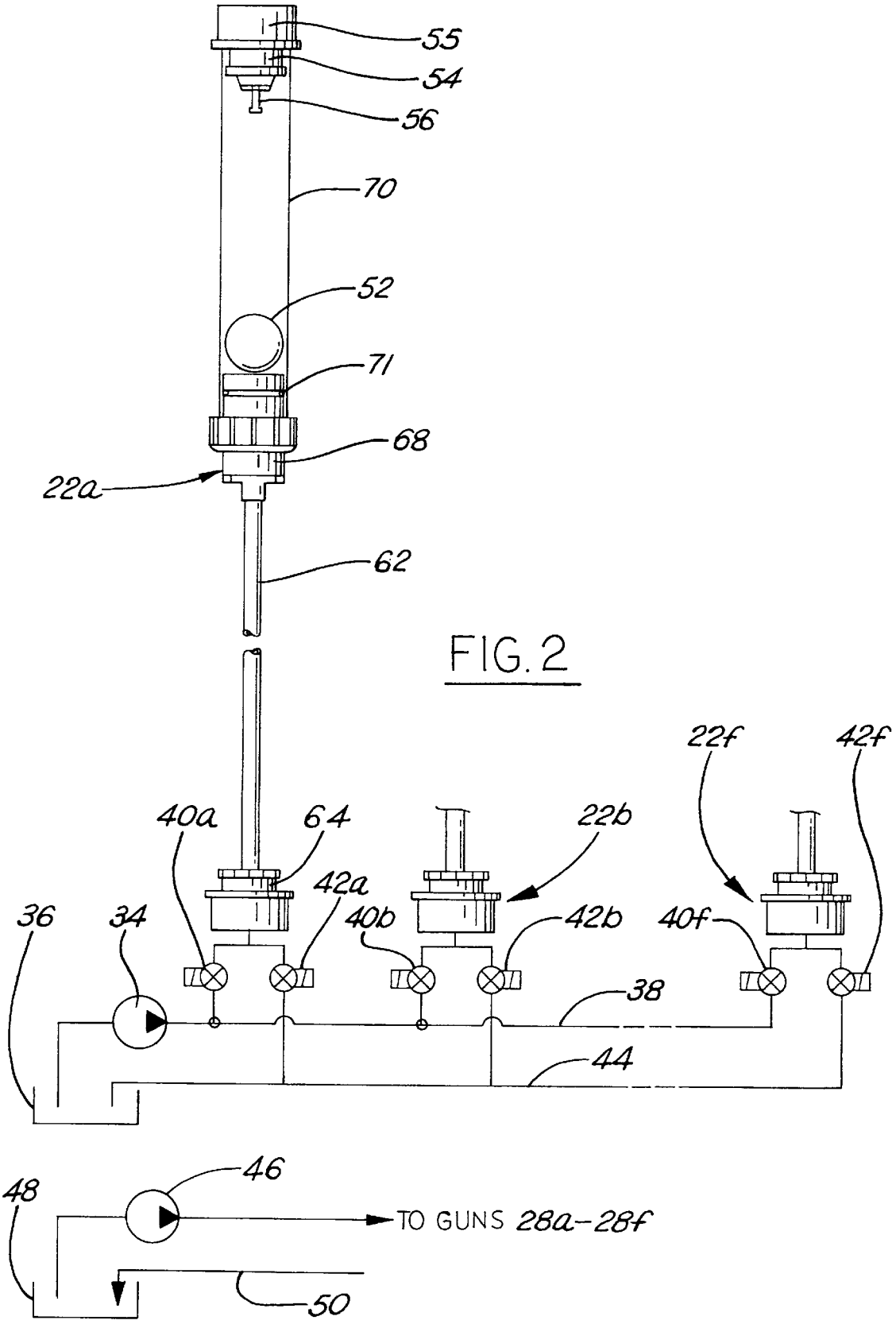
FIG. 2 is a schematic diagram the water column game illustrated in FIG. 1.
Figure 3:
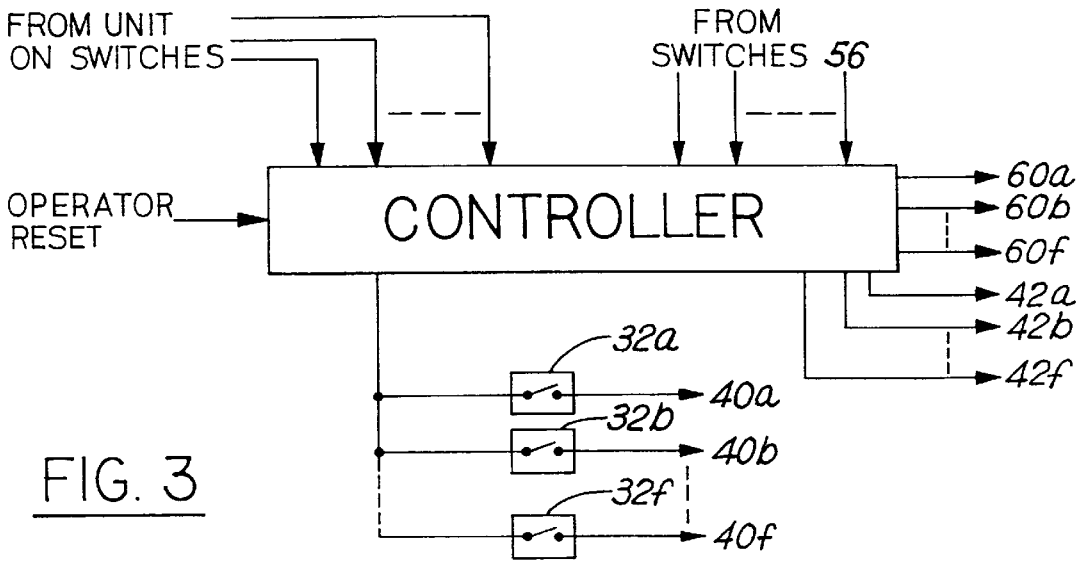
FIG. 3 is a functional block diagram of the electronic control for the water column game illustrated in FIGS. 1 and 2.
Figure 7:
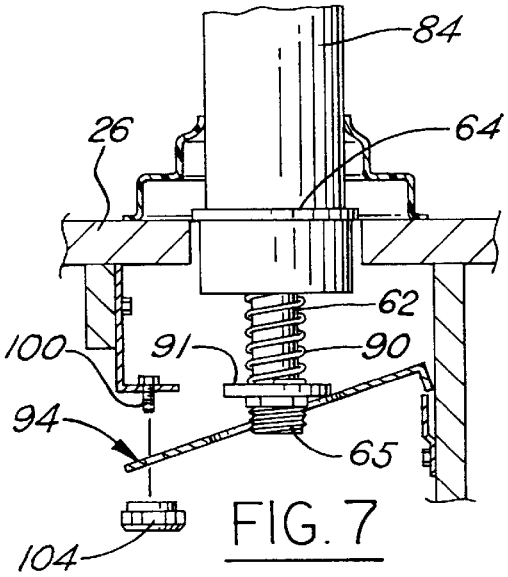
FIGS. 7 and 8 comprise fragmentary plan views of a portion of the column assembly illustrated in FIGS. 4–6B during assembly and disassembly.
Figure 8:
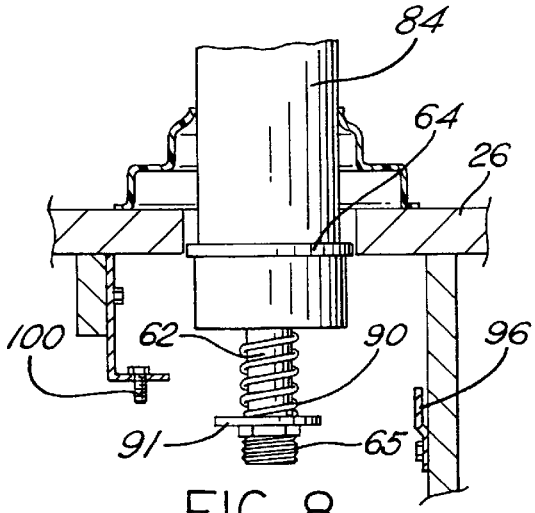
Figure 9:
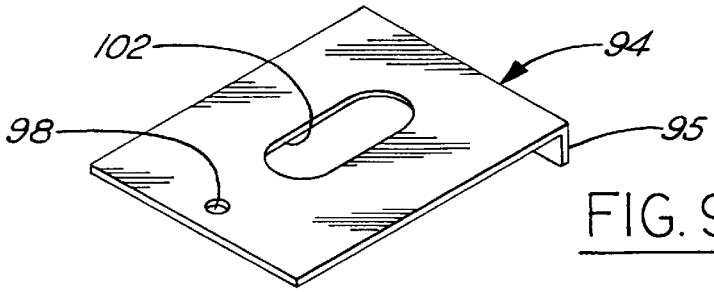
FIG. 9 is a perspective view of a portion of the assembly illustrated in FIGS. 4–7.
Figure 4:
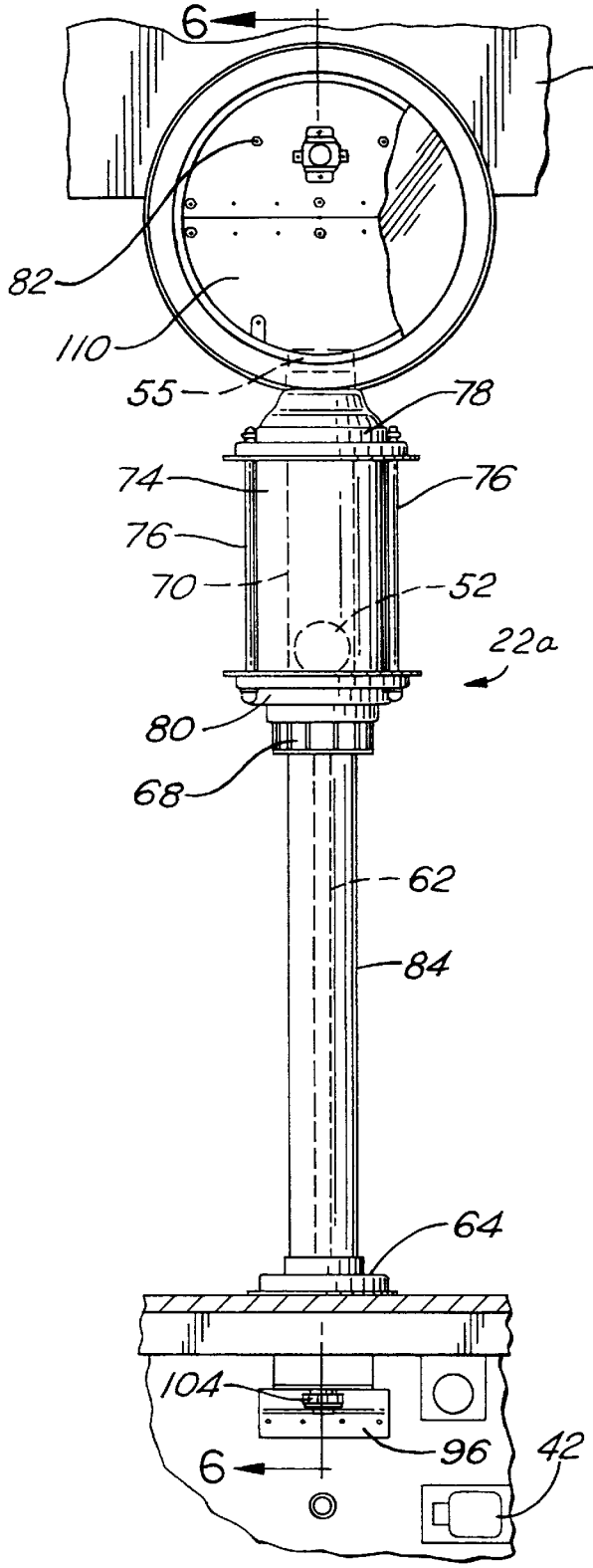
FIG. 4 is a front elevational view of a water game column assembly and associated support structure in accordance with a presently preferred embodiment of the invention.
Figure 5:
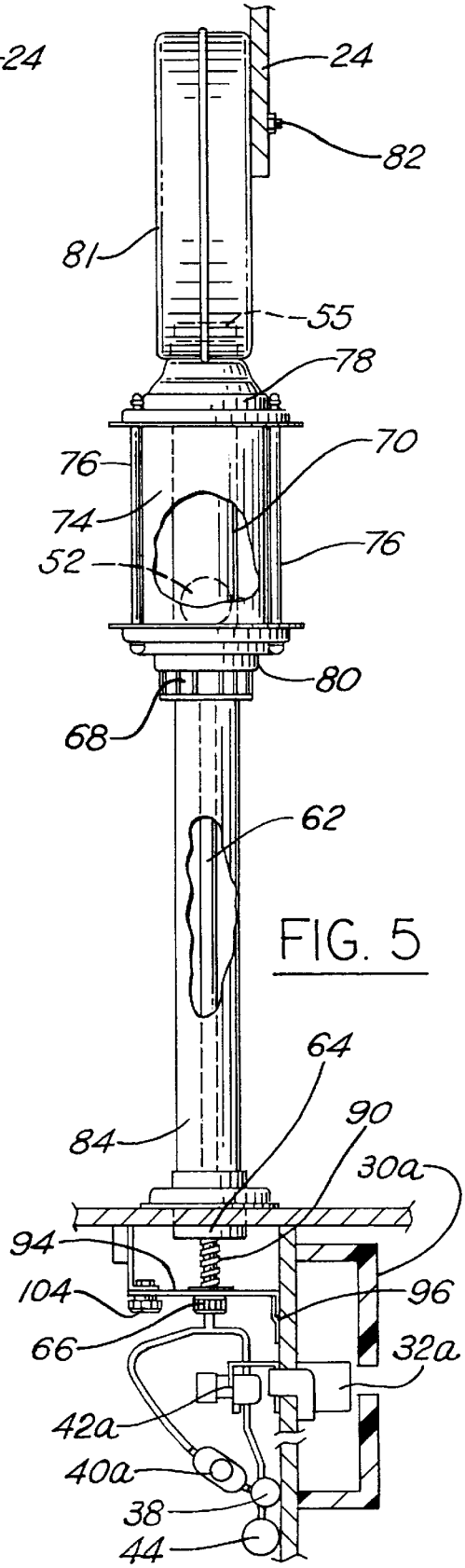
FIG. 5 is a side elevational view of the water game column and support illustrated in FIG. 4.
Figure 6A:
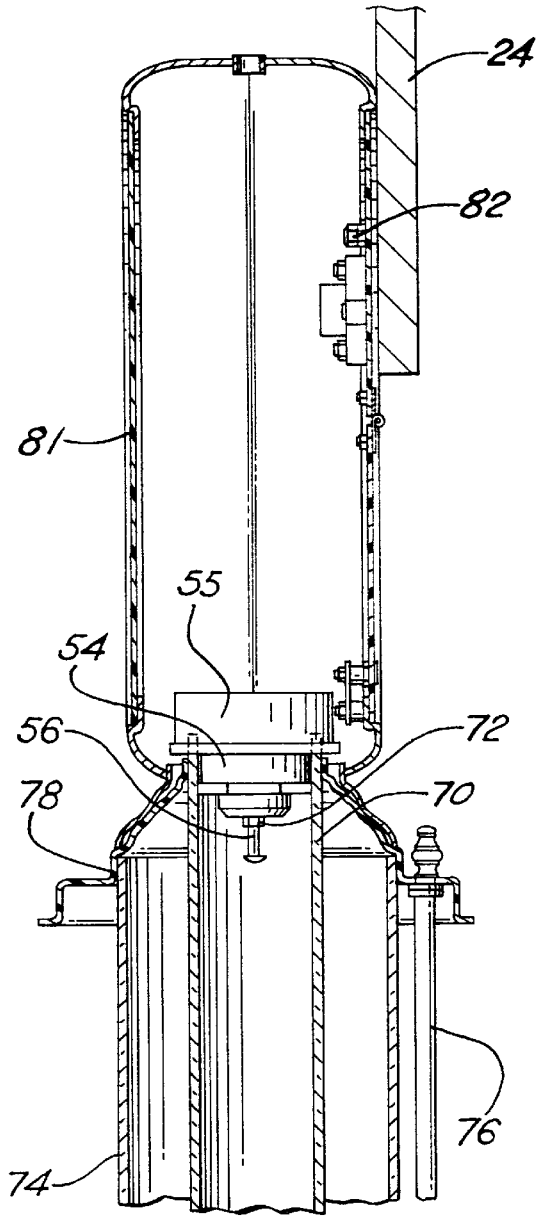
FIGS. 6A and 6B together comprise a fragmented sectional view on an enlarged scale taken substantially along the line 6—6 in FIG. 4.
Figure 6B:
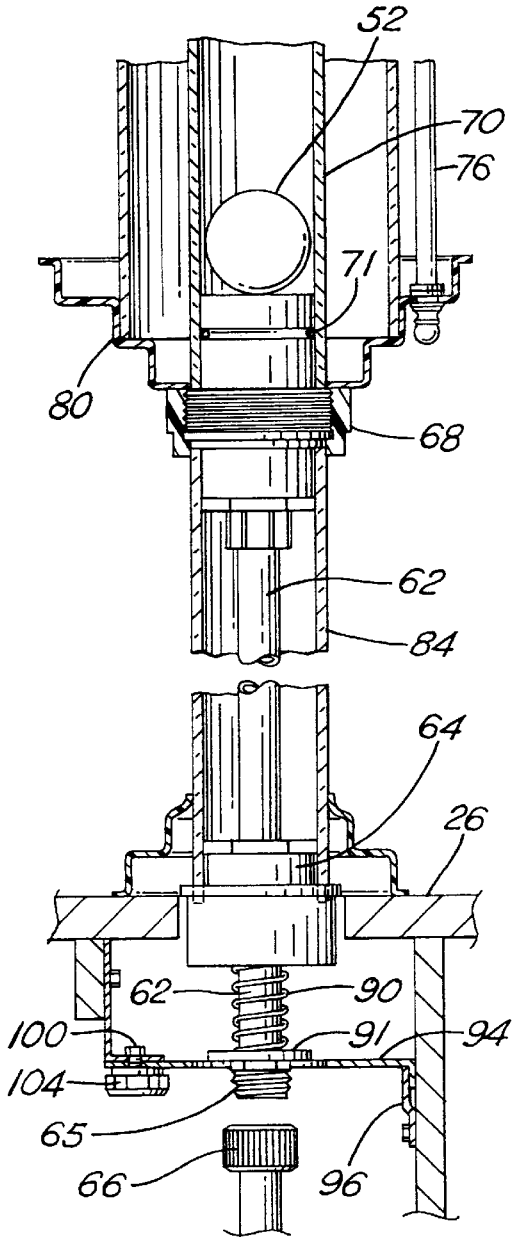

FIGS. 1 and 2 illustrate a water column game 20 in accordance with a presently preferred embodiment of the invention as comprising a plurality of identical column assemblies 22*a*–22*f* captured in a vertically oriented parallel and equally spaced array between upper and lower support sections 24, 26 of a transportable game trailer or fixed park stand. A player water gun 28*a*–28*f* is disposed in lateral alignment with each associated column assembly 22*a*–22*f* for directing a stream of water under control of a player toward an associated apertured target 30*a*–30*f*, each disposed in front of and beneath an associated column assembly 22*a*–22*f*. Behind each target 30*a*–30*f* has an associated target switch 32*a*–32*f* (FIG. 3 and 5) that is responsive to impingement of a water stream through the overlying target aperture from an associated gun 28*a*–28*f* for providing an electrical signal indicating that the player at that game station has hit the target. A single water pump 34 (FIG. 2) feeds water from a sump 36 to a manifold 38 (FIGS. 2 and 5) common to all column assemblies 22*a*–22*f*. A normally closed solenoid valve 40*a*–40*f* (FIGS. 2, 3 and 5) at each game station selectively connects manifold 38 to the open lower end of the associated overlying column assembly 22*a*–22*f*. Likewise, a normally open solenoid valve 42*a*–42*f* at each game station selectively connects the lower end of each column assembly 22*a*–22*f* to a common manifold 44 for returning water from all columns 22*a*–22*f* to common sump 34. A second pump 46 feeds water from a second sump 48 to all guns 28*a*–28*f*, and such water as is captured from the guns is returned by a drain line 50 to sump 48. Pumps 34, 46 are sized to provide water at identical pressure and flow rate at all game stations independent of player load.

Each water column assembly 22*a*–22*f* contains a float ball 52 that is buoyant in water. An electronic switch 54 is disposed within a switch housing 55 at the upper end of each column assembly 22*a*–22*f*, and has a switch contact 56 that projects downwardly into the column assembly for contact with the associated ball 52 as the ball is buoyantly raised by water filling the column. All of the column assembly float switches 54 are connected as parallel inputs to an electronic controller 58 (FIG. 3), along with unit-on inputs associated with each game station to indicate that the station is on—e.g., that the player has paid to play. When play begins, indicated by an operator reset input to controller 58, controller 58 supplies power to all target switches 32*a*–32*b*, and simultaneously closes the drain valves 42*a*–42*f* associated with valid or paid play stations. When a target switch 32*a*–32*f* indicates that a player at a particular station is hitting the target, the switch closes and applies power to open the associated valve 40*a*–40*f*. Water is thus fed from manifold 38 to the lower end of the associated column assembly 22*a*–22*f*. Thus, when a player hits a target, water is fed to the associated column assembly. When one of the column assemblies fills sufficiently to bring the associated float 52 into contact with the associated contact 56 and switch 54, the signal input from that float switch activates controller 58 to energize an associated player lamp 60*a*–60*f* (FIG. 1) to indicate that that player is the winner of that game round. Simultaneously, controller 58 de-energizes all valves 42 so as to drain all columns 22*a*–22*f* to return manifold 44 and sump 36 (FIG. 2). All column assemblies are simultaneously and completely drained.

Thus, the first player to fill the associated column assembly and bring the associated ball 52 into contact with the associated contact 56 is automatically designated the winner of that game round, and all columns are drained. The game operator may award prizes as appropriate, and reset the game for a new play round by providing an appropriate reset input to controller 58. It will be noted that each switch 54 is activated by a contact 56 that projects downwardly for contact with ball float 52. The water in the column never reaches the upper end of the column, and never contacts switch 54. Controller 58 preferably comprises a microprocessor-based controller, although a relay panel controller, solid state programmable controller or other suitable control means may be employed without departing from the present invention.

Water column assembly 22*a* will be described in detail in connection with FIGS. 4–9, the other water column assemblies 22*b*–22*f* being identical thereto. Water column assembly 22*a* comprises a hollow cylindrical water column 62 in the form of an elongated tube that is open at both ends. The lower end of tube 62 extends through a gland 64 to a threaded sleeve 65 for removable connection to a fitting 66. The upper end of column 62 opens through a transition union 68 into a cylindrical housing 70. Housing 70 is carried by union 68 coaxially with column tube 62, being sealed with respect thereto by an O-ring 71. The diameter of housing 70 is greater than the diameter of column tube 62. Switch 54 and housing 55 removably close the upper end of housing 70, and float ball 52 is freely disposed within housing 70, being captured therein by union 68 and switch 54. The contact 56 of switch 54 comprises a screw that adjustably threadably extends from switch 54, being locked in adjusted position by a jam nut 72. Housing 70 is surrounded by a sleeve 74 that is captured by an array of threaded fasteners 76 between a pair of opposed cup-shaped elements 78, 80. A second hollow cylindrical sleeve 84 surrounds column tube 62, being fastened at its upper end to union 68 and at its lower end to gland 64. Housing 70 and sleeve 84 are of identical diameter. Sleeve 84 provides structural support for column tube 62.

A flat circular enclosure 81 is affixed by screws 82 to upper support structure 24. Enclosure 81 has a lower opening that telescopically receives and holds the upper end of housing 70 and the upper end of element 78. Switch 54 and switch housing 55 are disposed within housing 81 over the upper end of housing 70 so that adjustable contact 56 projects downwardly into housing 70 as previously described. Sleeves 74, 84, housing 70 and column tube 62 are all preferably of transparent plastic construction. The water supplied to all columns by pump 34 from sump 36 preferably includes a suitable dye clearly visible through the transparent construction of the column assembly elements, and ball 52 is of a coloration that is readily visible through housing 70 and sleeve 74. In this way, players may readily observe progress of each game round both at their own column assemblies and at the column assemblies of other contestants. The diameter of float ball 52 preferably closely approximates but is slightly less than the inner diameter of housing 70, so that movement of ball 52 upwardly and downwardly within housing 70 helps scrape any algae off the inside wall of the housing. The reduced diameter of column tube 62 helps reduce accumulation of algae within that portion of the water column. It is to be noted in this connection that water does not enter the space between housing 70 and sleeve 74, or between column tube 62 and sleeve 84. Thus, algae does not accumulate on the inside surfaces of either of the sleeves.

At the lower end of column tube 62, a coil spring 90 and a washer 91 are loosely captured between gland 64 and fitting 65 mounted on the end of the column tube. A plate 94 has a flange 95 along one edge for receipt within a bracket 96 carried by lower support structure 26, and an opening 98 along the opposing edge for receipt over a screw 100 also carried by support structure 26. The central portion of plate 94 has an elongated aperture 102 (FIG. 9) for receipt over fitting 65 and engagement with washer 91 at the lower end of column tube 62. As the flange 95 of plate 94 is fitted within bracket 96 and the opposing end of plate 94 is swung upwardly over screw 100, the central portion of the plate is thus received over fitting 92 and engages washer 91 at the lower end of spring 90. Spring 90 is thus compressed against gland 64 so as to urge column assembly 22*a* upwardly into and against the opening at the lower end of housing 81. A nut 104 is removably received over screw 100 to capture plate 94 in the position illustrated in FIG. 5. Coil spring 90 thus resiliently urges column assembly 22*a* upwardly against housing 81. This resilient mounting of column assembly 22*a* accommodates substantial vibration as the game is transported between sites without damage to the game components or column assemblies. In the event that column assembly 22*a* must be removed for maintenance or repair, fittings 65, 66 are disengaged, knob 104 is removed from screw 100, plate 94 is removed, the lower end of column tube 62, sleeve 84 and gland 64 is moved downwardly into lower support 26 until the upper end of the column assembly clears housing 80. The column assembly is then lifted upwardly and outwardly for maintenance or repair as desired. The column assembly or a replacement assembly may be readily installed by reversal of this procedure. Housing 81 has a hinged door 110 that may be unlocked and pivoted upwardly for access to switch 54 and any lamps or bulbs carried within the housing.

An important feature of the present invention lies in the ability to adjust the water-fill volumes of the several column assemblies to be equal to each other, so that each player has an equal opportunity to win during each game play. That is, during initial set-up with all housing doors 110 open, jam nuts 72 associated with switch contacts 56 of the several switches 54 are all loosened, and all contacts 54 are adjustably positioned so that all columns take the same amount of time to fill with valves 40 fully opened. This may be accomplished, for example, by measuring the amount of time required for each column assembly to fill, and adjusting switch contacts 56 until all times are identical. Jam nuts 72 are then tightened to lock these volume adjustments. It is to be noted that this volume adjustment will remain constant even if one or more column assemblies are removed for maintenance or repair as long, as individual components that may affect water volume are not replaced or recut. Thus, during normal operation, it should not be necessary to readjust the fill volumes of the various column assemblies. Use of a single pump 34 and a single fill manifold 38 further ensures game fairness by supplying water to all columns at identical pressure and flow rate.

I claim:

1. A water column game that comprises:

a hollow vertically oriented tube that is open at both ends, an open housing disposed at an upper end of said tube and having a diameter greater than that of said tube, said housing being coaxial with and in open communication with said upper end of said tube, support means for engaging an upper end of said housing and a lower end of said tube for holding said housing and tube in vertical orientation, said support means comprising means for resiliently engaging said lower end of said tube so as to urge said upper end of said housing against said support means, float means buoyant in water captured within said housing and free to move within said housing, a water gun responsive to an operator for generating a water stream, a target spaced from said gun adjacent to said tube and responsive to impingement of a water stream from said gun to generate an electrical signal, an electronic control valve responsive to said electrical signal for feeding water, from a source under pressure separate from said gun and said stream produced thereby, to a lower end of said tube such that water rises within said tube and then within said housing so as to lift said float means within said housing, switch means disposed at an upper end of said housing and responsive to contact by said float means for indicating that said float means has reached said upper end of said housing, and means for variably adjusting volume of water fed to said tube and housing to bring said float means into contact with said switch means.

2. The game set forth in claim 1 comprising at least two of said tubes each having a said housing, float means, water gun, electronic control valve, switch means and volume adjusting means associated therewith, all of said electronic control valves being connected to a common water manifold coupled to a water pump for feeding water to all of said tubes at identical pressure and flow rate.

3. The game as set forth in claim 1 comprising a plurality of said tubes each having a said housing, float means, water gun, target, valve and switch means associated therewith, a common water manifold coupled to a water pump, both said manifold and said pump being separate from said guns, said manifold and said pump comprising said source under pressure coupled to said valves, each said valve being responsive to associated electrical signals for feeding water under pressure to its respective tube at identical pressure and flow rate.

4. The game set forth in claim 1 wherein said volume-adjusting means comprises means coupled to said switch means for adjusting position at which said float means contacts said switch means within said housing.

5. The game set forth in claim 2 further comprising means associated with each said tube and housing for equalizing water volumes of all of such tubes and housings.

6. The game set forth in claim 5 wherein said volume-equalizing means comprises means coupled to said switch means for adjusting position at which said float means contacts said switch means within said housing for each said tube.

7. The game set forth in claim 2 further comprising means responsive to said switch means for all of said tubes for draining water from all of said tubes simultaneously when a first of said switch means is activated by a float means.

8. The game set forth in claim 7 wherein said draining means comprises a normally open valve associated with each of said tubes, and means for opening all of said normally open valves when a first of said switch means is activated by a float means such that all of said tubes remain open to drain between plays.

9. The game set forth in claim 3 wherein said volume-adjusting means comprises means coupled to each said switch means for adjusting position at which the float contacts said switch means within each said housing.

10. The game set forth in claim 4 wherein said switch means and said position-adjusting means are both disposed vertically above said float means at an upper end of said housing.

11. A water column game that comprises:

a hollow vertically oriented tube that is open at both ends, an open housing disposed at an upper end of said tube and having a diameter greater than that of said tube, said housing being coaxial with and in open communication with said upper end of said tube, float means buoyant in water captured within said housing and free to move within said housing, means responsive to a player for directing water into a lower end of said tube such that water rises within said tube and then within said housing so as to lift said float means within said housing, switch means disposed at an upper end of said housing and responsive to contact by said float means for indicating that said float means has reached said upper end of said housing, and support means for engaging an upper end of said housing and a lower end of said tube for holding said housing and tube in vertical orientation, including means for resiliently engaging said lower end of said tube so as to urge said upper end of said housing against said support means.

12. The game set forth in claim 11 wherein said support means further includes means for releasing said resiliently engaging means so as to relieve pressure holding said upper end of said housing against support means such that said tube and housing may be removed as a unit from said support means.

13. The game set forth in claim 12 wherein said resiliently urging means comprises a coil spring encircling a lower end of said tube, and wherein said releasing means comprises a plate having means at opposed edges for affixation to said support means and means between said edges for surrounding a lower end of said tube and engaging said coil spring so as to capture the spring in compression.

* * * * *